US008424641B2

(12) United States Patent
Pandazopoulos et al.

(10) Patent No.: US 8,424,641 B2
(45) Date of Patent: Apr. 23, 2013

(54) BARRIER ASSEMBLY

(75) Inventors: Andrew Pandazopoulos, New South Wales (AU); Roland Blundell, New South Wales (AU); Brian Whelan, New South Wales (AU)

(73) Assignee: Workright Edge Protection Systems Pty Ltd (AU)

( * ) Notice: Subject to any disclaimer, the term of this patent is extended or adjusted under 35 U.S.C. 154(b) by 150 days.

(21) Appl. No.: 12/523,783

(22) PCT Filed: Dec. 11, 2007

(86) PCT No.: PCT/AU2007/001905

§ 371 (c)(1),
(2), (4) Date: Jul. 20, 2009

(87) PCT Pub. No.: WO2008/086557

PCT Pub. Date: Jul. 24, 2008

(65) Prior Publication Data

US 2010/0089696 A1 Apr. 15, 2010

(30) Foreign Application Priority Data

Jan. 19, 2007 (AU) ..... 2007201540
Jan. 19, 2007 (AU) ..... 2007900228

(51) Int. Cl.
*E04G 21/32* (2006.01)

(52) U.S. Cl.
USPC ..... 182/113

(58) Field of Classification Search ..... 182/113; 256/1, DIG. 6, 59, 67, 68, 52; 248/316.5
See application file for complete search history.

(56) References Cited

U.S. PATENT DOCUMENTS

| | | | | | |
|---|---|---|---|---|---|
| 866,195 | A | * | 9/1907 | Dillman et al. | 248/316.5 |
| 1,450,644 | A | * | 4/1923 | Pracht | 256/52 |
| 3,584,839 | A | * | 6/1971 | Dickey | 256/59 |
| 3,848,854 | A | * | 11/1974 | De Barbieri | 256/70 |
| 3,964,215 | A | * | 6/1976 | Hartman et al. | 52/9 |
| 4,236,698 | A | * | 12/1980 | Compte | 256/23 |
| 4,338,875 | A | * | 7/1982 | Lisowski | 114/221 R |
| 4,465,262 | A | * | 8/1984 | Itri et al. | 256/24 |
| 4,799,641 | A | * | 1/1989 | Koreski | 248/68.1 |
| 4,830,341 | A | * | 5/1989 | Arteau et al. | 256/65.14 |
| 5,263,550 | A | * | 11/1993 | Jines et al. | 182/113 |

(Continued)

FOREIGN PATENT DOCUMENTS

| | | |
|---|---|---|
| AU | 2005229756 | 8/2006 |
| GB | 1560751 | 2/1980 |

(Continued)

*Primary Examiner* — Alvin Chin Shue
(74) *Attorney, Agent, or Firm* — Mayback & Hoffman, P.A.; Gregory L. Mayback; Rebecca A. Tie

(57) ABSTRACT

A barrier assembly includes an upright frame that supports a barrier including a pair of slidably coupled barrier members that are adjustable in length and are supported by a stirrup as well as the frame. The frame attached to the barrier members to support the barrier members is able to attach to a supporting surface. The frame extends upwardly from the supporting surface to support the barrier members at a position spaced from the supporting surface. The frame has a clamp device that engages the members to prevent sliding movement between the barrier members and thereby removably fixes the barrier members at a desired length and fixes the barrier members to the frame.

9 Claims, 8 Drawing Sheets

U.S. PATENT DOCUMENTS

| | | | | |
|---|---|---|---|---|
| 5,556,079 | A | 9/1996 | West | |
| 5,653,349 | A * | 8/1997 | Dana et al. | 211/189 |
| 6,038,829 | A * | 3/2000 | Franks | 52/645 |
| 6,279,880 | B1 * | 8/2001 | Hawks, Jr. | 256/67 |
| 7,063,186 | B1 * | 6/2006 | Granke | 182/113 |
| 2006/0054393 | A1 * | 3/2006 | Eisenkrein | 182/113 |

FOREIGN PATENT DOCUMENTS

| | | |
|---|---|---|
| GB | 2387857 | 10/2003 |
| JP | 8240010 | 9/1996 |
| JP | 11141139 | 5/1999 |
| WO | 2008086557 | 7/2008 |

* cited by examiner 45
43
46
44
44

13
44
49
48
42
11
47

50
46
44
12
53

51
43
52
54
52
54

BARRIER ASSEMBLY

CROSS-REFERENCE TO RELATED APPLICATION

This application claims the priority, under 35 U.S.C. §§119, 120, 363, and 371, of Australia Provisional Patent Application No. 2007900228 and Australia Patent Application No. 2007201640, both filed Jan. 19, 2007, which designated the U.S. and was published in English; the prior applications are herewith incorporated by reference in their entirety.

STATEMENT REGARDING FEDERALLY SPONSORED RESEARCH OR DEVELOPMENT n/a

FIELD OF THE INVENTION

The present invention relates to barrier assemblies and more particularly but not exclusively to barrier assemblies employed on construction sites and more particularly but not exclusively to barrier assemblies such as temporary fencing and rail systems for floor slab edge installation during the construction of multi storey buildings.

BACKGROUND OF THE INVENTION

During construction, and prior to the floors being permanently closed (for example by a curtain wall) temporary fencing is required adjacent the periphery of floor slabs for safety purposes.

Current barrier assemblies have a number of disadvantages including difficulty in providing openings for the purposes of gates, difficulty in respect of accommodating different lengths to which the barrier assemblies are to be applied, difficulty in respect of installation adjacent slab edges, difficulty in accommodating columns and other protrusions, inhibiting work that is to be performed beyond the barrier assembly, such as the installations of brackets and curtain walls, with the workmen remaining on the safe side of the barrier assembly and providing suitable connection points for anchors used for safety lines and harnesses.

SUMMARY OF THE INVENTION

There is disclosed herein a barrier assembly including:

a barrier having a longitudinal generally horizontal length provided by a pair of slidably coupled barrier members, with relative sliding longitudinal movement between the barrier members providing for adjustment of said length; and at least one upright attached to the members to support the members, the upright being provided to be attached to a supporting surface.

Preferably, said upright is a frame to extend upwardly from the surface to support the members at a position spaced from the surface.

Preferably, said assembly includes a support attached to the members and extending downwardly therefrom to engage said surface to aid in supporting the members above said surface, said support being spaced from said upright.

Preferably, said assembly includes a clamp device engaging the members to prevent sliding movement between the members so that the barrier has a desired length.

Preferably, said frame incorporates said clamp device so that the clamp device also fixes the members to the frame.

Preferably, said clamp is an arm pivotally mounted for angular movement about a horizontal axis between a release position and a clamp position with respect to said members.

Preferably, said first member has at least one longitudinally extending channel within which said second member is slidably located.

Preferably, said first member has two longitudinally extending channels, the channels being an upper channel and a lower channel within which said second member is slidably located.

Preferably, said upright is provided with a harness anchor point.

Preferably, said upright is provided with at least one shaped aperture to provide for the attachment of accessories to the upright.

There is further disclosed herein a kickboard assembly for a barrier, said kickboard assembly including an elongated base, said base being relatively rigid, and a resilient member extending longitudinally of the base and projecting therefrom.

Preferably, said base has an upper and a lower longitudinally extending edge portion and said flexible member is attached to said base adjacent said lower portion Preferably, said base has a longitudinally extending groove, and said flexible member a longitudinally extending projection located within the groove to secure the flexible member to the base, said groove being located adjacent said lower portion.

Preferably, said base has a second longitudinally extending groove, the second groove being located adjacent said upper portion, and said flexible member has a second longitudinally extending portion locatable in said second groove, to selectively locate the flexible member adjacent the base.

Although the invention is illustrated and described herein as embodied in a seat with pivoting backrest, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
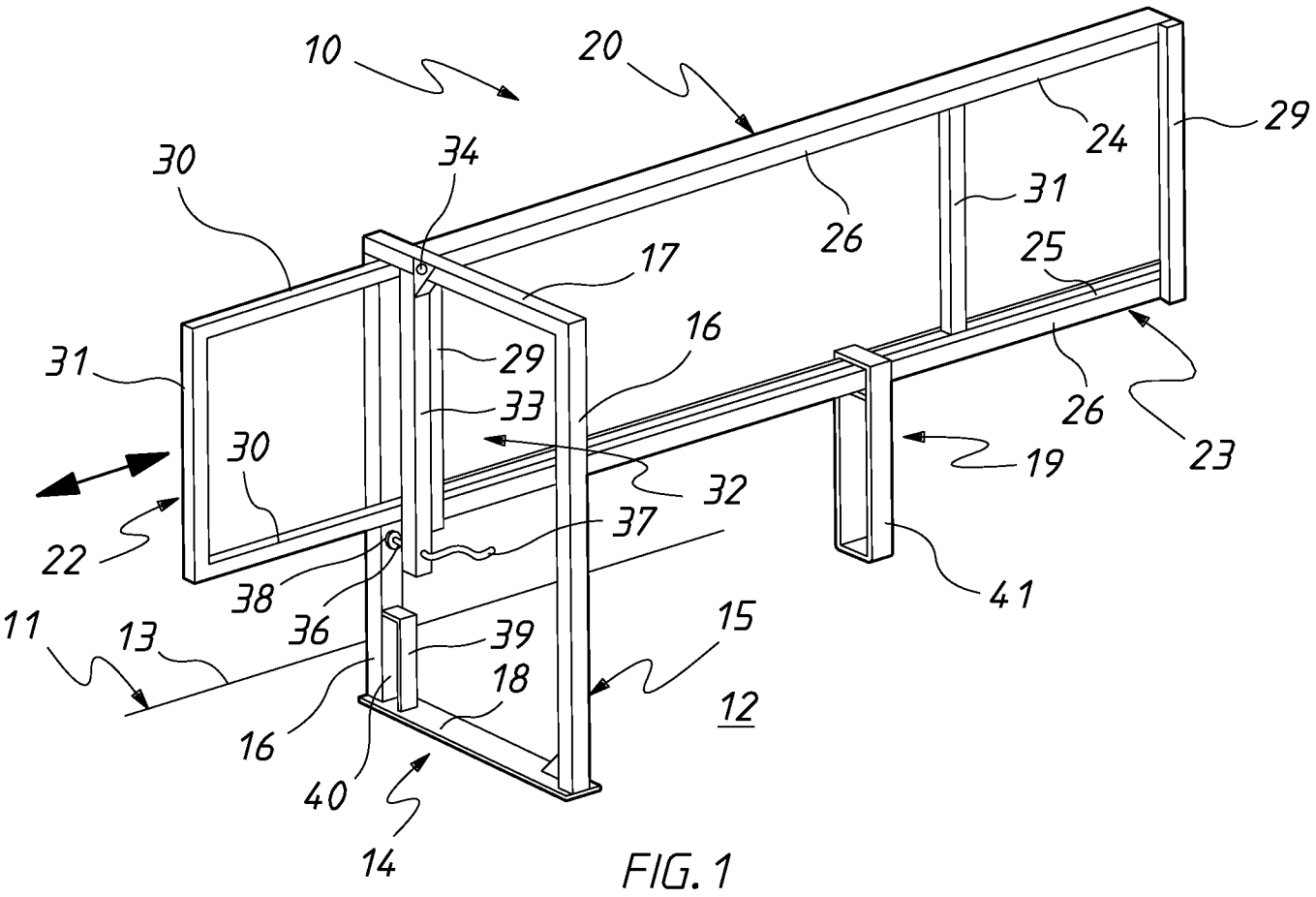
FIG. 1 is a perspective view of an exemplary embodiment of a barrier assembly according to the invention with a fragmentary portion of the environment to which the barrier assembly is attached.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is disclosed and described, it is to be understood that the terminology used herein is for the purpose of describing particular embodiments only and is not intended to be limiting. It must be noted that, as used in the specification and the appended claims, the singular forms "a," "an," and "the" include plural references unless the context clearly dictates otherwise.

While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

In the accompanying drawings there is schematically depicted a barrier assembly 10. The barrier assembly 10 is to be fixed to the upper surface 12 of a concrete floor slab 11 having an edge 13.

The assembly 10 includes an upright 14 which in this embodiment is a frame 15. The frame 15 has generally vertically oriented posts (uprights) 16 joined at their upper ends by a transverse brace 17 and a bottom plate 18. Typically the plate 18 would be bolted to the slab 11.

The posts 16 are generally parallel and the brace 17 and plate 18 are generally normal to the posts 16 and therefore also generally parallel.

In the present embodiment only one frame 15 is illustrated. However a plurality of frames 15 may also be employed.

Supported by the frame 15 and a foot (support) 19 is a barrier 20. The barrier 20 has a longitudinal generally horizontal length 21 and includes a pair of barrier members 22 and 23. The members 22 and 23 are slidably coupled so that sliding relative movement therebetween adjusts the length 21.

The member 23 includes a top and a bottom rail 24 and 25, each rail 24 and 25 includes a tubular member 26 to which there is attached an "angle" member 28 so that there are guide channels 27 provided within which the member 22 is slidably located.

In this respect it should be appreciated both members 22 and 23 are slidable through the stirrup 19, with the foot 19 being spaced from the frame 15 so as to support the barrier 20 in a raised position relative to the surface 12.

The barrier member 23 has end vertical end portions 29.

The member 22 has upper and lower tubular rails 30 and vertical end portions 31.

To retain the members 22 and 23 in a desired configuration providing a desired length 21, they are clamped together by means of a clamp device 32. The clamp device 32 includes a clamp bar 33 pivotally attached at its upper end to the portion 17 by means of a pivot pin 34 for angular movement about a generally horizontal axis 35 that is generally parallel to the barrier 20. The axis 35 is spaced from the barrier 20 so the clamp member 33 provides a space within which the barrier 20 is located.

The lower end of the clamp bar 33 is provided with a threaded shaft 36 having a handle 37 that is manipulated by a user. The threaded shaft 36 engages a nut 38 fixed to the post 16. Upon angular movement of the shaft 36 by manipulation of the handle 37, the clamp bar 36 is moved into clamping engagement with the barrier 20 to clamp it, and therefore fix it, in a predetermined position relative to the frame 15.

Figure 2:
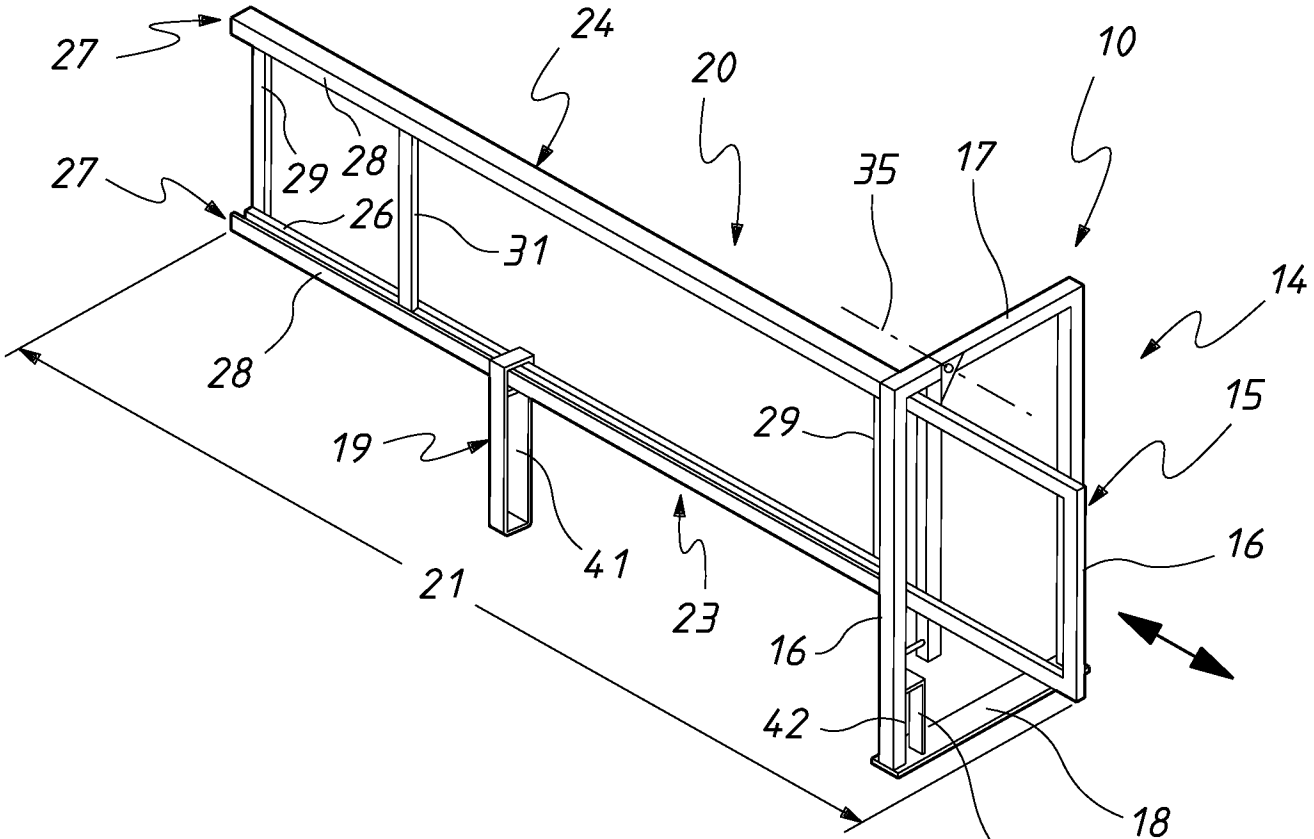
FIG. 2 is a perspective view of the barrier assembly of FIG. 1 viewed from an opposite side.

As is best seen in FIGS. 1 and 2, the barrier 20 is horizontally longer than it is vertically deep.

The frame 15 is provided with a bracket 39 providing an aperture 40 aligned with the aperture 41 of the stirrup 19. The apertures 40 and 41 receive portion of the kickboard assembly 42 so as to retain the kickboard assembly 42 generally positioned below the barrier 20. The kickboard assembly 42 includes a base 43 that would have end portions engaged in the apertures 40 and 41 so as to be supported thereby. The base 43 has longitudinally extending grooves 44. In this regard the base 43 has an upper longitudinally extending portion 45 and a lower longitudinally extending portion 46, with the lower groove 44 being located adjacent or at the lower portion 46. The upper groove 44 is located adjacent the upper portions 45.

Releasably attached to the base 43 is a flexible member 47. The flexible member 47 has an end lip 48 with a longitudinally extending projection 49 that is received within the lower groove 44 so as to attach the flexible member 47 to the base 43. As is best seen in FIG. 3, the flexible member 47 has a lower sheet portion 50 joined to the lip 48, with the sheet portion 50 having a further projection 51 that is received within the upper groove 44 to aid in securing the flexible member 47 in a raised position generally abutting the base 43.

Preferably, the base 43 is an extruded aluminium section and is generally rigid relative to the flexible member 47. Typically the flexible member 47 would be formed of rubber, synthetic rubber or other flexible plastics material.

Figures 3, 4, 5:
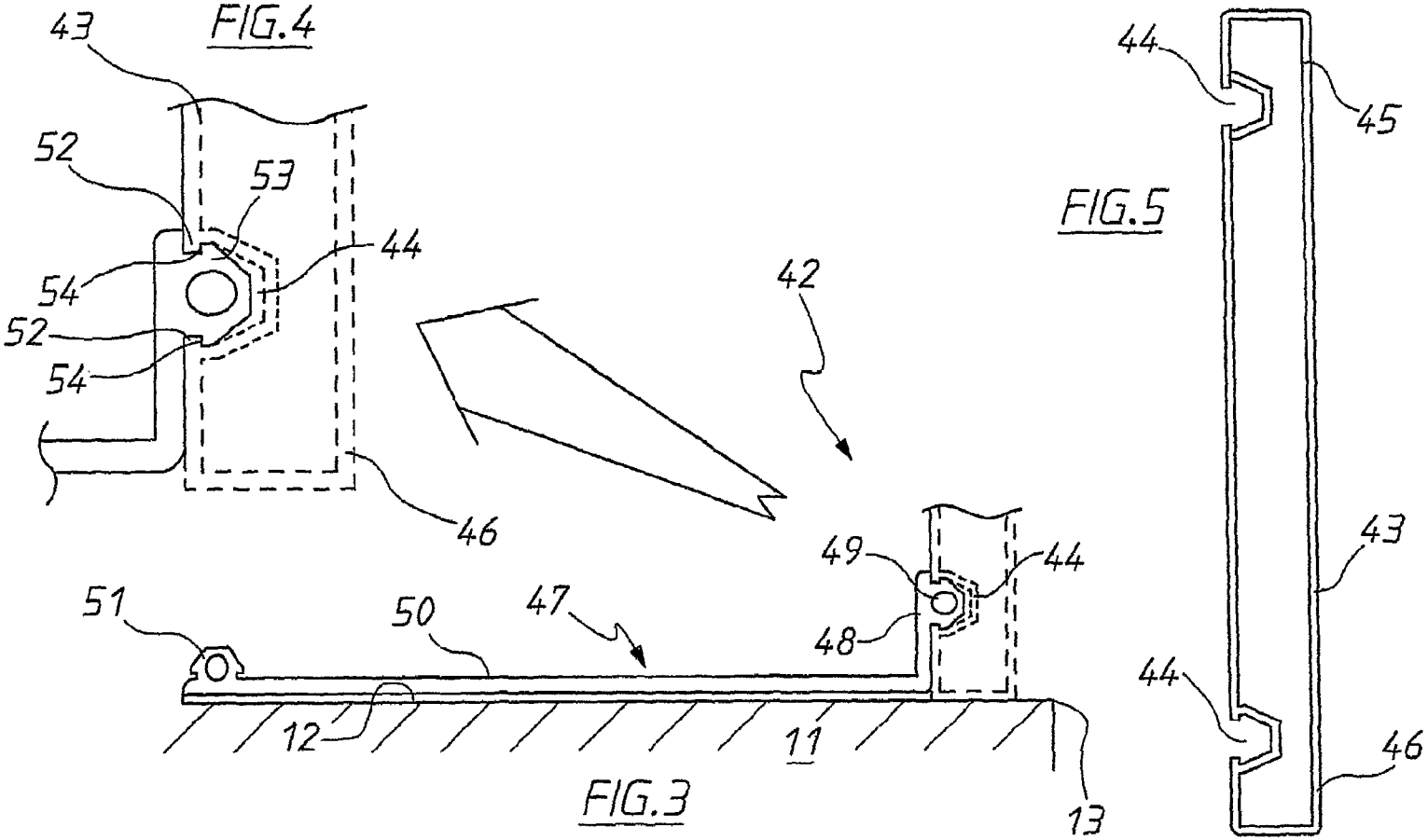
FIG. 3 is a fragmentary side elevational view of an exemplary embodiment of a kickboard assembly to be used with the barrier assembly of FIG. 1 with a base portion of the barrier assembly shown in phantom.
FIG. 4 is a fragmentary side elevational view of an enlarged portion of the assembly of FIG. 3.
FIG. 5 is a side elevational view of an exemplary embodiment of a kickboard base employed in the assembly of FIG. 3.

As best seen in FIG. 4, each groove 44 has entrance flanges 52 that engage the head 53 of each projection 49. Each head 53 has steps 54 that engage the adjacent flange 52 to aid in retaining the projection 47 in the associated slot 44. Resilient deformation of the head 49 provides for insertion and removal with respect to the associated slot 44.

Figure 6:
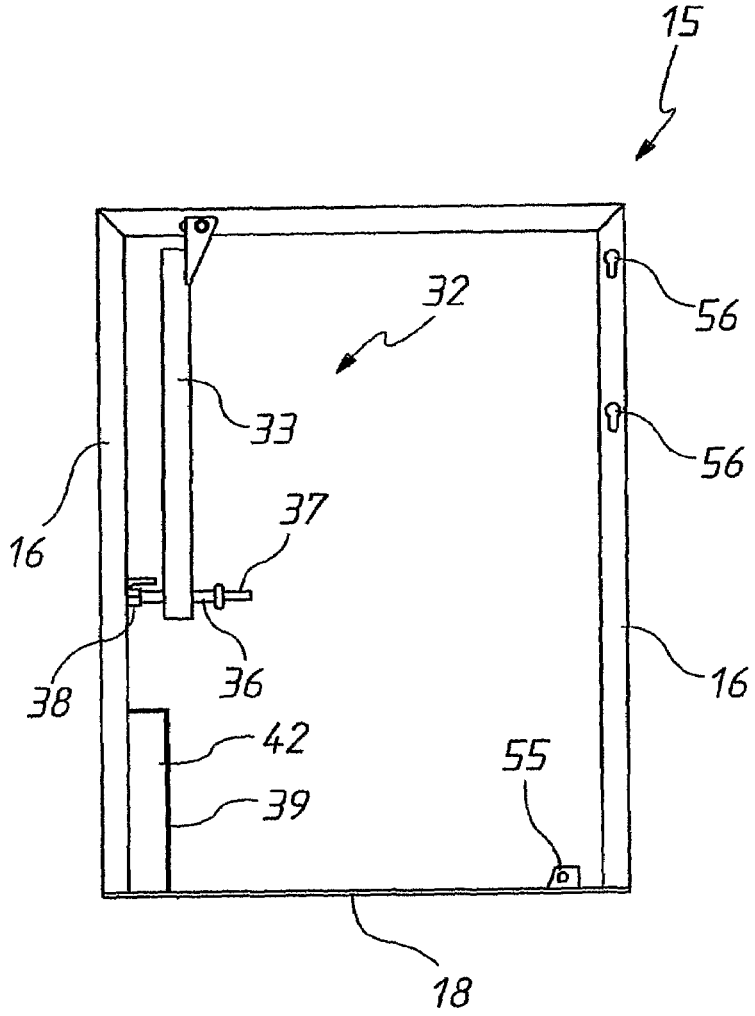
FIG. 6 is a side elevational view of an exemplary embodiment of a frame employed in the barrier assembly of FIG. 1.

As best seen in FIG. 6, the frame 15 includes an eyelet 55 providing an anchor point for a harness to be worn by a user. At least one of posts 16 is provided with one or more apertures 56 that are preferably of a "key hole" configuration providing for the attachment of accessories such as stands and screens to the frame 15.

Figure 7:
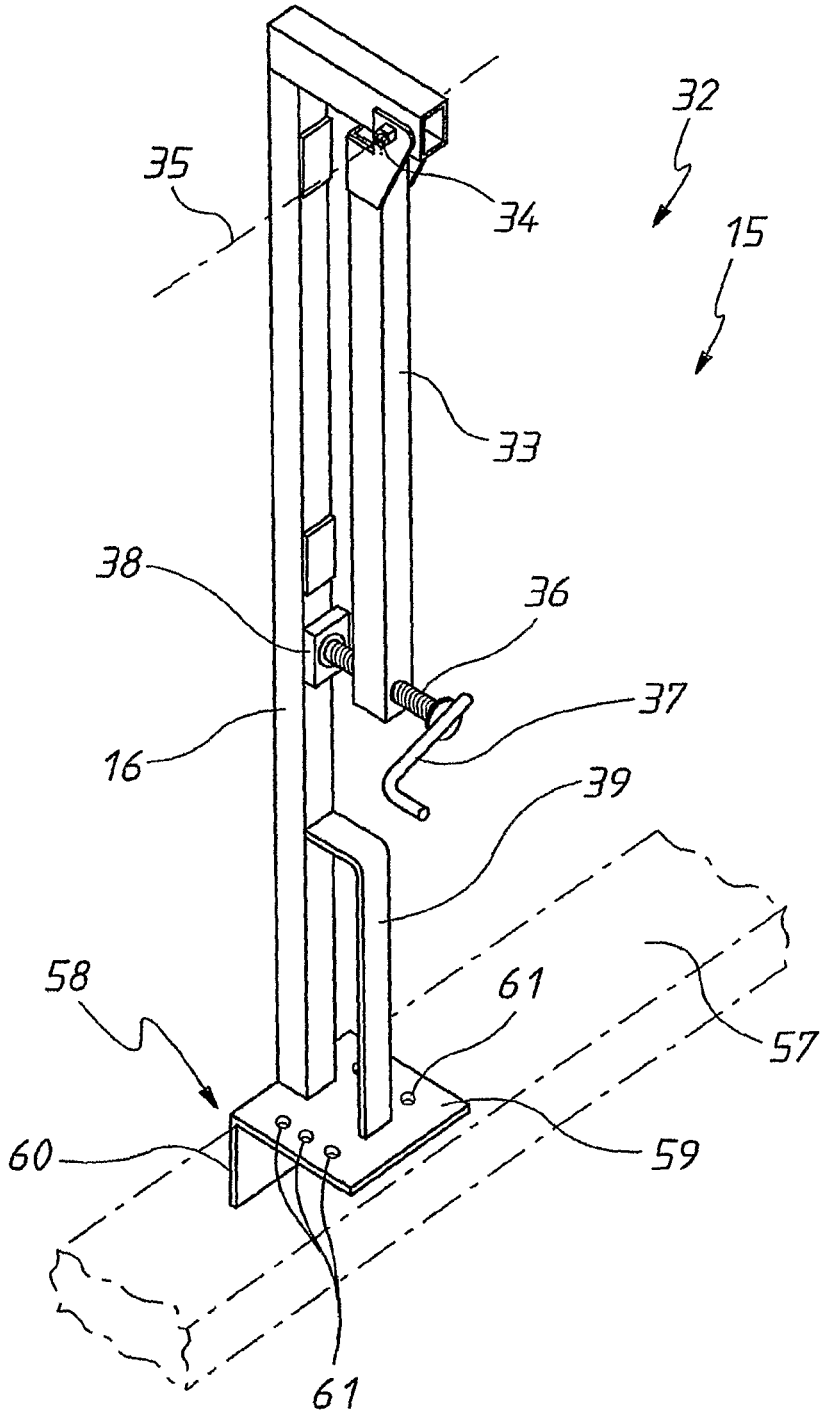
FIG. 7 is a perspective view of another exemplary embodiment of the frame of FIG. 6 with a fragmentary portion of the environment shown in phantom.

In FIG. 7 there is schematically depicted a modification of the frame 15. In this embodiment the frame 15 is configured to be attached to a horizontal metal beam 57. For example, the beam 57 could be a metal beam of the frame of a multistorey building. The beam 57 would be horizontally oriented.

The frame 15 includes a base 58 of "L-shaped" configuration so as to have a generally horizontal plate 59 and a generally vertical flange 60. Fixed to the plate 59 is the post 16, clamp bar 33, handle 37 and shaft 36, while attached to post 16 is the nut 38. As with the previous frame 15, a pivot pin 34 is provided providing the axis 35.

The plate 59 is provided with a plurality of apertures 61 through which fasteners pass to secure the frame 15 to the beam 57.

Figure 8:
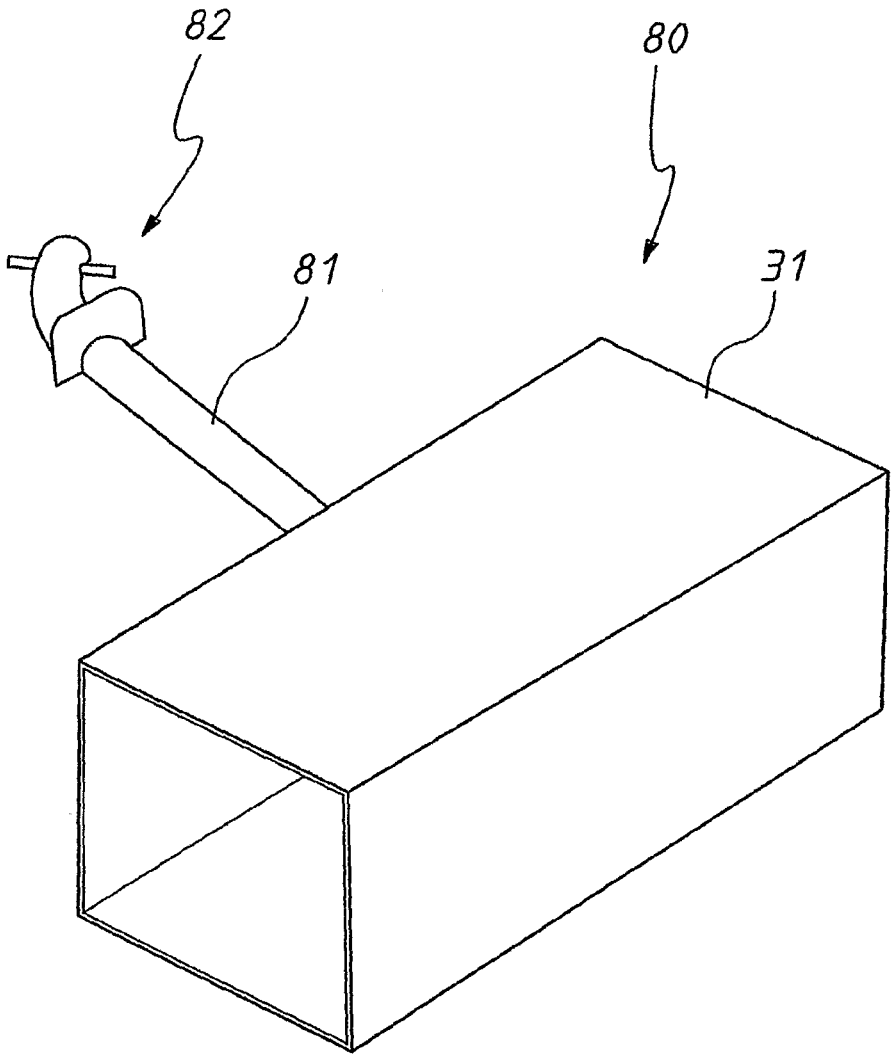
FIG. 8 is a perspective view of an exemplary embodiment of an attachment for the barrier assembly of FIG. 1.

In FIG. 8 there is schematically depicted an attachment 80. The attachment 80 has a vertical stem 81 providing an attachment portion 82 to engage within one of the apertures 56 to support a socket 83 through which a bar would extend. The socket 83 and bar passing therethrough would provide a barrier inhibiting movement pass the attachment 80.

Figure 9:
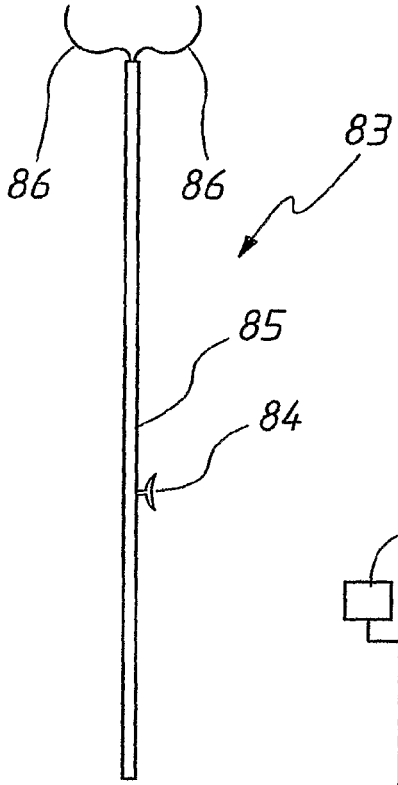
FIG. 9 is a side elevational view of another exemplary embodiment of an attachment for the barrier assembly of FIG. 1.

In FIG. 9 there is schematically depicted a "lead stand" 99 that would have a projection 84 engaging in one of the apertures 56. The stand 99 would include a vertical post 85 at the upper end of which there is provided hooks 86 over which electric leads would pass so as to be suspended above the adjacent floor surface.

Figure 10:
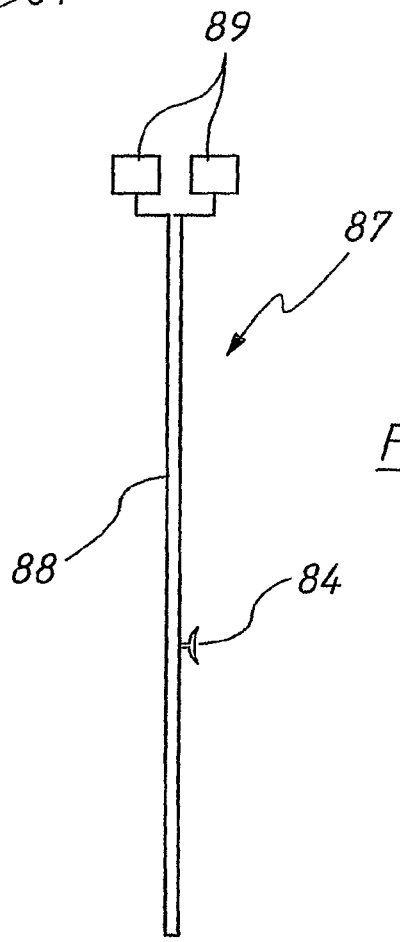
FIG. 10 is a side elevational view of yet another exemplary embodiment of an attachment for the barrier assembly of FIG. 1.

In FIG. 10 there is schematically depicted a "light stand" 87. The stand 87 includes a projection 84 that would be located in one of the apertures 56. The stand 87 includes a post 88 at the upper end of which there is attached electrically operated lamps 89.

Figure 11:
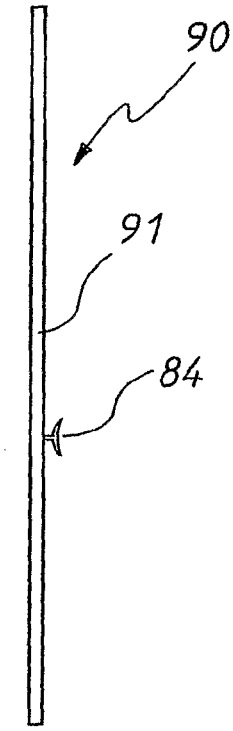
FIG. 11 is a side elevational view of still another exemplary embodiment of an attachment for the barrier of FIG. 1.

In FIG. 11 there is schematically depicted an extension bar 90. The bar 90 includes a generally upright post 91 provided with a projection 84 that is received within one of the apertures 56. The bar 91 provides a height extension for items that are to be attached to the barrier 10.

Figure 12:
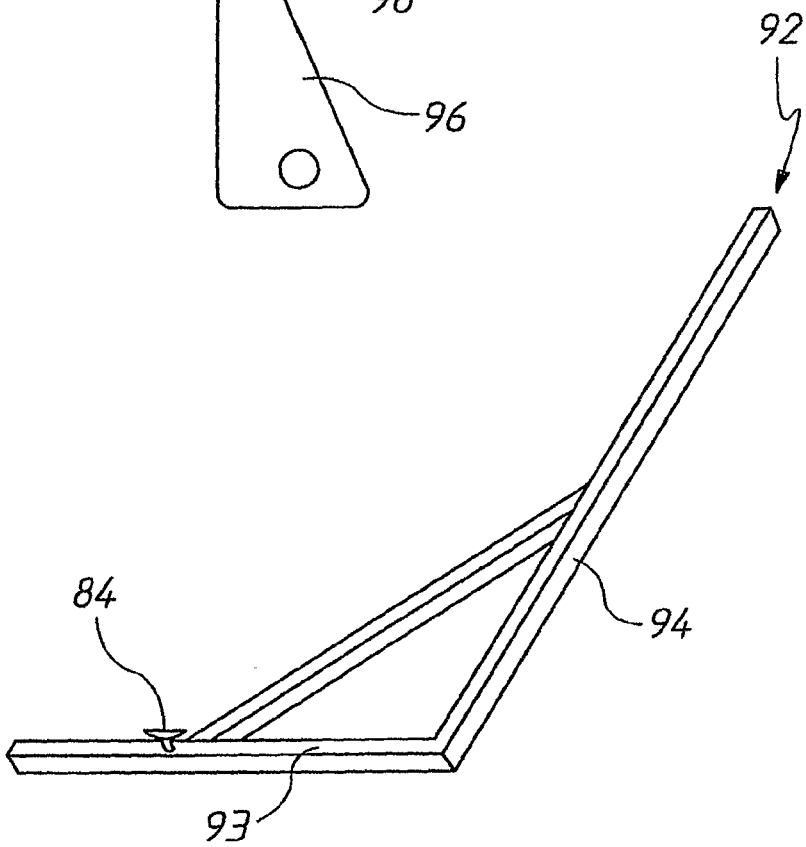
FIG. 12 is a perspective view of an exemplary embodiment of a bracket to be employed with the barrier assembly of FIG. 1.

In FIG. 12 there is schematically depicted a bracket 92. The bracket 92 includes a first bar 93 having one of the projections 84 that is received within one of the apertures 56. Attached to the bar 93 is a further bar 94, the bar 94 being provided to support sheet material or net material that is to provide a "safety net" extending beyond the periphery of the floor surface to which the barrier 10 is to be attached.

Figure 13:
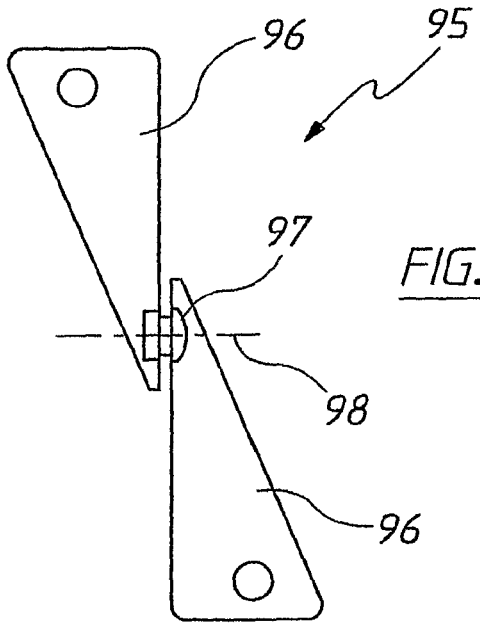
FIG. 13 is a plan view of an exemplary embodiment of a corner bracket to be employed with the barrier assembly of FIG. 1.

In FIG. 13 there is schematically depicted a "corner" bracket 95. The corner bracket 95 includes a pair of plates 96 pivotally attached by a pivot 97 for angular movement about an axis 98. The plates 96 are attached to adjacent barrier assemblies 10, the pivot 97 accommodating angular displacement between the adjacent barriers 10.

In the above described preferred embodiment, the barrier assembly 10 has the advantage of being locatable adjacent the edge 13 while also being adjustable in length 21. Still further the flexible member 47 covers apertures extending inwardly from the edge 13, while the projection 51 is selectively locatable in the upper groove 44 to retain the sheet portion in a raised position spaced from the horizontal rest portion laying on the surface 12. Use of the clamp assembly 32 enables sliding movement of the members 22 and 23 to provide openings when desired.

The foregoing description and accompanying drawings illustrate the principles, preferred embodiments and modes of operation of the invention. More specifically, the encrypted identification systems and methods according to the present invention have been described with respect to an inventory system and process. However, the invention should not be construed as being limited to the particular embodiments discussed above. Additional variations of the embodiments discussed above will be appreciated by those skilled in the art as well as for applications, unrelated to inventory, that require encrypted identification of parts.

The above-described embodiments should be regarded as illustrative rather than restrictive. Accordingly, it should be appreciated that variations to those embodiments can be made by those skilled in the art without departing from the scope of the invention as defined by the following claims.

The invention claimed is:

1. A barrier assembly, comprising:

a barrier having a longitudinal horizontal length defined by a pair of slidably coupled barrier members, with relative sliding longitudinal movement between the barrier members providing for adjustment of said length;

at least one upright attached to said barrier members to support the barrier members, said upright capable of being attached to a supporting surface; and wherein said upright is a frame extending laterally from said barrier to engage said surface so as to extend upwardly from said surface, said frame comprising:

an upright post extending upwardly from said surface;

an outer upright post extending upwardly from said surface;

a transverse brace joining an upper end of said upright post to an upper end of said outer upright post; and a clamp operable to releasably secure the barrier to the frame so as to support the barrier and to provide a desired length for the barrier, said clamp comprising an upright arm pivotally mounted to said transverse brace for angular movement about a horizontal axis between a release position and a clamp position wherein said barrier is clamped between said upright arm and said upright post.

2. The assembly according to claim 1, wherein said frame supports the barrier members at a position spaced from the supporting surface so that said barrier is spaced from said supporting surface.

3. The assembly according to claim 1, further comprising a support attached to the barrier members and extending downwardly therefrom to engage said supporting surface to aid in supporting the barrier members above said surface, said support being spaced from said upright.

4. The assembly according to claim 1, further comprising a rotatable threaded member operatively associated with said upright post and said upright arm to pivotally move said upright arm toward said upright post so that said barrier is clamped between said upright post and upright arm.

5. The assembly according to claim 1, wherein a first of said pair of barrier members has at least one longitudinally extending channel within which the second of said pair of barrier members is slidably located.

6. The assembly according to claim 5, wherein the first of said pair of barrier members has two longitudinally extending channels, the channels being an upper channel and a lower channel within which said second of said pair of barrier members is slidably located.

7. The assembly according to claim 1, wherein said upright is provided with a harness anchor point.

8. The assembly according to claim 1, wherein said upright is provided with at least one shaped aperture to provide for the attachment of accessories to the upright.

9. A barrier assembly comprising:

a barrier having a longitudinal horizontal length defined by a pair of slidably coupled barrier members, with relative sliding longitudinal movement between the barrier members providing for adjustment of said length;

at least one upright attached to said barrier members to support said barrier members, said upright being capable of being attached to a supporting surface, wherein said upright is a frame extending laterally from said barrier to engage said surface so as to extend upwardly from said surface, said frame comprising:

a foot piece for placement on said surface;

an upright post in use extending upwardly from said foot piece;

an outer upright post extending upwardly from said foot piece;

a transverse brace joining an upper end of said upright post to an upper end of said outer upright post; and a clamp operable to releasably secure the barrier to the frame so as to support the barrier and to provide a desired length for said barrier, said clamp comprising an upright arm pivotally mounted to said transverse brace for angular movement about a horizontal axis between a release position and a clamp position wherein said barrier is clamped between said upright arm and said upright post.

* * * * *